United States Patent [19]

Bryson

[11] 4,222,431

[45] Sep. 16, 1980

[54] CONTINUOUS CASTING WITH RESILIENT STRIP-EDGE GRIPPING MEANS

[75] Inventor: Neil B. Bryson, Kingston, Canada

[73] Assignee: Alcan Research and Development Limited, Montreal, Canada

[21] Appl. No.: 919,314

[22] Filed: Jun. 26, 1978

[30] Foreign Application Priority Data

Jul. 4, 1977 [GB] United Kingdom ..... 27907/77

[51] Int. Cl.³ ..... B22D 11/128

[52] U.S. Cl. ..... 164/89; 164/440; 164/441

[58] Field of Search ..... 164/441, 447, 82, 440, 164/431, 432, 89, 448

[56] References Cited

U.S. PATENT DOCUMENTS

| | | | |
|---|---|---|---|
| 2,284,503 | 5/1942 | Williams | 164/442 X |
| 3,110,941 | 11/1963 | Fagg | 164/432 |
| 3,349,837 | 10/1967 | Brondyke et al. | 164/440 X |
| 3,465,809 | 9/1969 | Jensen et al. | 164/82 |
| 3,700,027 | 10/1972 | Petersen | 164/441 |
| 3,774,671 | 11/1973 | Rossi | 164/89 X |
| 3,797,557 | 3/1974 | Tseitlin et al. | 164/447 |

*Primary Examiner*—Robert D. Baldwin
*Assistant Examiner*—J. Reed Batten, Jr.
*Attorney, Agent, or Firm*—Cooper, Dunham, Clark, Griffin & Moran

[57] ABSTRACT

Aluminium and other non-ferrous metals are continuously cast in the form of a thin strip in a thickness range of 5–30 mm through an open-ended casting mould. The emerging strip is cooled in conventional manner by direct application of coolant as it emerges from the mould. The novel feature is that the solidified strip is gripped at its side edges at a station close to the exit of the mould and positively pulled out of the mould.

10 Claims, 2 Drawing Figures

1
2
3
4
5
6
7
8
A
C
M
S
T

CONTINUOUS CASTING WITH RESILIENT STRIP-EDGE GRIPPING MEANS

The present invention relates to the continuous casting of metals such as aluminium and its alloys and other metals and alloys, e.g., lead, zinc, copper and brass, which have melting points which are low in relation to steel. The invention is in particular directed to the casting of such metals in thin section by the direct chill continuous casting system.

It has long been known to be desirable to cast aluminium in thin section (for example, at a thickness of 25 mm or less) to provide material which can be fed directly into a cold-rolling mill without any previous hot rolling stage. There is a similar requirement with other metals which are to be coldrolled down to sheet or foil. Such thin section metal has been cast by the Hazelett process in which molten metal is supplied to the gap between two parallel horizontally moving steel belts, which define a mould in which a broad strip of metal is cast, the belts serving to define the broad faces of the resultant cast strip. Coolant is applied to the back of the belts to remove heat from the metal, which is not subjected to direct chill by the application of coolant to it. Owing to variable contact between the belts and the metal, the rate of heat removal through the belts is uneven with the result that many surface defects and local metallurgical variations occur in the cast strip. In the Hazelett process, in addition to the steel belts, moving edge dams are employed to confine the lateral spread of the molten metal between the belts.

In direct-chill continuous casting, as practised for the production of thick-section rolling ingots, molten metal is poured into a fixed openended chilled mould, which is effective to provide a solidified surface skin of metal, within which a central pool of still liquid metal is confined when the metal issues from the mould. Substantially all the cooling of the metal is achieved by the application of water directly to the surface of the solidified skin, as it emerges from the mould. Direct-chill continuous casting, as normally practised for the production of aluminium ingots, may involve the use of either a vertical mould or a horizontal mould. In the first case the growing ingot is supported by a vertically-movable stool and the metal is withdrawn from the mould by slowly lowering the stool at a controlled rate. On the other hand when using a horizontal mould, the growing ingot is withdrawn from the mould by means of pinch rolls, which engage its broad faces. However the use of pinch rolls in conjunction with a horizontal mould can lead to self-perpetuating surface defects. If a "bleed" or "cold shut" occurs on the surface of the material issuing through the mould, a vibration will occur as this local thickening passes through the pinch rolls and this will lead to a disturbance of the liquid metal meniscus in the mould, generating in its turn a further defect of the metal.

It is an object of the present invention to provide apparatus by means of which an improved thin aluminium strip, in a thickness range of 5–30 mm may be produced by direct chill continuous casting. While the invention contemplates that the strip may be cast vertically it is principally directed to casting in a horizontal mould (a mould from which the cast metal emerges in a horizontal direction), because of the difficulty of handling and withdrawing continuously cast thin aluminium strip from a vertical mould.

It has now been appreciated according to the invention that improved results can be achieved by withdrawing the strip from the mould by means of gripping means which grip the narrow side edges of the cast strip and travel with the strip. The gripping means most preferably takes the form of resiliently deformable, heat resistant material either in the form of a continuous band or as separate pads. In the latter case the pads are carried on a continuous, tension resisting band (which may be a belt, chain, cable or the like). In the former case the continuous band is preferably reinforced by tension-resisting reinforcement, such as a metal belt. The gripping means are pressed against the side edges of the strip, by for example a stationary backing, on which the band slides. The two gripping means travel on parallel paths and the associated bands are supported on pulleys or sprockets, which rotate about axes which are perpendicular to the plane in which the cast strip travels.

Where the strip is cast in a vertical direction, it may be sufficient to grip only the side edges of the strip, but where the strip is cast in a horizontal direction (including a direction upwardly or downwardly inclined in relation to the horizontal) it is necessary to provide some support on at least the lower broad face of the cast strip. Such support may be in the form of idler rolls or a stationary fluid support bearing acting at one or more locations on the lower broad face of the cast strip. More preferably however the support for the lower broad face of the strip is associated with and travels with the side edge gripping means. In some cases, particularly where very broad strip is cast, it is preferred to provide additional idler rollers or the like to support the strip at or near its centre line. Moreover, it is preferred to provide means for restraining the strip against upward movement, for example as a result of thermal strains.

In a preferred construction the gripping means comprises a continuous band of a heat resistant rubber or polyurethane material (resistant to the temperature of the cast strip edges) having a channel-shaped groove therein, so as to receive the edge portion of the cast strip therein. The resiliently deformable gripping band is itself, preferably, adhesively bonded to a plain metal band, such as a high-tensile steel or beryllium copper band, which slides on a stationary backing member. The long length of band gives overall support to the metal strip, yet can accommodate itself to local surface irregularities.

By elimination of the customary pinch rolls employed when casting metal horizontally through a stationary mould, self-propagating defects of the type described above are avoided. The elimination of pinch rolls is, in any event, desirable because of their tendency to skid on the strip surface and produce marks, which cannot be wholly eliminated in a subsequent rolling operation.

On the other hand it is unimportant that in employing the present invention the metal strip may be contacted on one or both wide faces by gripping bands at locations near the side edges since this part of the strip will be trimmed off in a subsequent stage of fabrication.

Referring to the accompanying drawings.

Figures 1, 2:
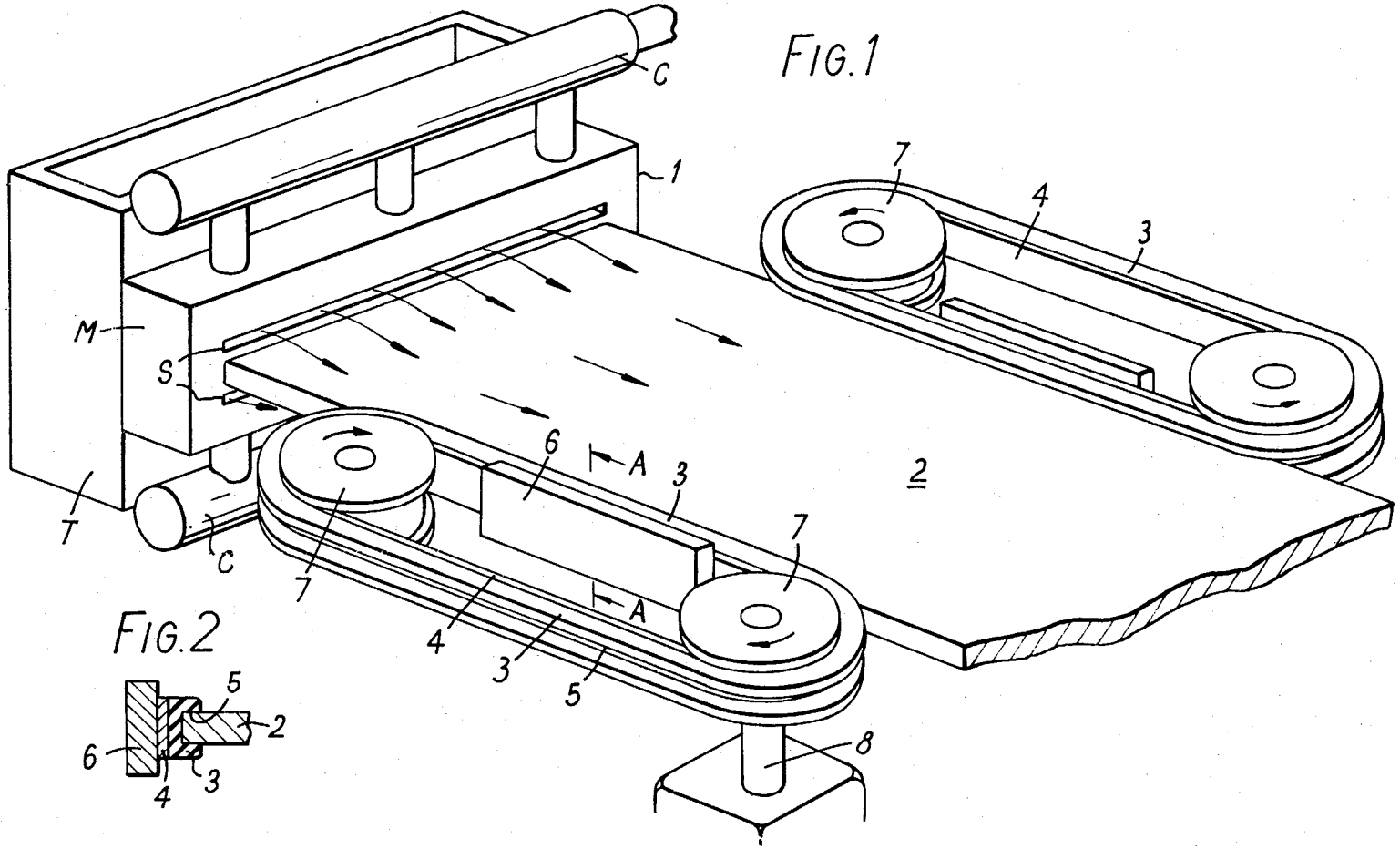
FIG. 1 shows one form of apparatus made in accordance with the invention.
FIG. 2 shows a section on line A—A of FIG. 1.

In FIG. 1 a conventional horizontal continuous casting mould is illustrated at 1. The mould is provided with a conventional metal supply tundish T, from which metal flows to the horizontal mould unit M, to which coolant is supplied through supply manifolds C and issues through upper and lower coolant emission slits S so that in conventional manner coolant is directed onto the whole top and bottom surfaces (broad faces) of the cast strip as it emerges from the mould 1. At a short distance after emerging from the mould 1, the edges of the strip 2 are gripped by gripping belt 3, adhesively bonded to a plain metal band 4. As will be seen the gripping belt 3, which is formed of a slightly compressible, heat resistant rubber has a groove 5, which is shaped to positively grip both the side edges and a small portion of the broad faces of the strip. Thus the normal transverse dimension of the groove 5 is equal to or preferably slightly less than the thickness of the cast strip at its edges. The belts 3 are forced against the side edges of strip 2 by stationary back up members 6, which are coated with a low friction material, such as Teflon. The combination belts 3–4 are received in grooved drive pulleys 7, mounted on drive spindles 8. The opposed parallel portions of the belts 3, gripping the side edges of the strip 2, travel in a direction generally aligned with the aperture in the mould M so that the hot strip is not subjected to bending as it leaves the mould. The belts 3 do not come into gripping engagement with the strip until it reaches the periphery of the first drive pulley, which may be a distance of 50 to 100 mms from the outlet end of the mould. It will be appreciated that at the beginning of a casting operation it is necessary to employ an auxiliary member to close the outlet end of mould 1 and to draw out the leading end of the cast strip to bring it into engagement with the gripping belts 3. However that is conventional procedure in casting through a horizontal mould. It will be seen that at the vicinity of the mould outlet the whole surface of the strip is subjected to unobstructed application of coolant. When the operation has been started up, casting may be continued over very long periods.

The use of channel-grooved rubber gripping belts has the effect of damping out any mechanical vibrations induced in the cast strip and thus avoids the rearward transmission of such vibrations to the liquid metal meniscus at the mould inlet.

This method of casting thin metal strip has been employed for casting a wide range of aluminum alloys in the thickness range of 5–10 mms and at speeds of up to 1500 mm/min and higher. The resulting strip has possessed good surface properties and has been suitable for production of cold-rolled aluminum strip without further surface treatment.

The cast strip withdrawal system described above has a very low inertia and can be made to operate very smoothly, so that the cast strip is withdrawn at substantially constant velocity thus avoiding cyclic change at the liquid metal meniscus at the inlet to the mould.

I claim:

1. A method for continuously casting metal in the form of a strip of a thickness in the range of 5 to 30 mm which comprises supplying molten metal to a fixed open ended casting mould having an essentially rectangular passage therethrough, such passage having a minimum transverse dimension in the range of 5 to 30 mm, withdrawing metal strip continuously from the exit end of said casting mould passage, applying liquid coolant to at least the broad faces of the metal strip issuing from said mould passage at a location adjacent to the mould exit, the withdrawal of the cast strip from the mould passage being effected at least primarily by pressing resilient gripping means against the opposed side edges of the emerging cast strip at locations proximate the mould exit and progressing the gripping means at opposed side edges in parallel paths which maintaining pressure against the side edges of the strip.

2. A method for continuously casting metal in the form of a strip of a thickness in the range of 5 to 30 mm which comprises supplying molten metal to an open ended casting mould having an essentially rectangular passage therethrough, such passage having a minimum transverse dimension in the range of 5 to 30 mm, withdrawing metal strip continuously from the exit end of said casting mould passage, applying liquid coolant to at least the broad faces of the metal strip issuing from said mould passage at a location adjacent to the mould exit, the withdrawal of the cast strip from the mould passage being effected by pressing resilient gripping means against the opposed side edges of the emerging cast strip at locations proximate the mould exit and progressing the gripping means at opposed side edges in parallel paths while maintaining pressure against the side edges of the strip, said method being a method wherein the strip is cast through the mould, arranged to cast the strip with its broad faces substantially horizontal, and wherein the metal strip is withdrawn from the mould be means of a pair of belts of rubber-like material, each of said belts having therein a generally channel-shaped groove having a transverse dimension no greater than the thickness of said strip adjacent its side edges whereby said rubber-like belts grip said strip and restrain it from movement in a direction perpendicular to its broad faces when said belts are pressed against the side edges of said strip, said belts having opposed parallel lengths which are progressed in a direction generally aligned with the mold passage.

3. Apparatus for continuously casting metal strip comprising a fixed mould having an essentially rectangular passage extending therethrough, said passage having a minimum transverse dimension in the range of 5–30 mms, means for supplying molten metal to the inlet end of said mould passage, means for applying liquid coolant to the broad faces of a metal strip emerging from the exit end of said mould passage and means for continuously withdrawing said emerging strip at least primarily at opposed side edges, said withdrawal means comprising at each side of the path of said emerging strip, a continuously moving belt-like member carrying strip-gripping means composed of resilient rubber-like material, the pair of belt-like members being spaced at such distance that they press the strip-gripping means into engagement with the narrow side faces of said strip.

4. Apparatus for continuously casting metal strip comprising a mould having an essentially rectangular passage extending therethrough, said passage having a minimum transverse dimension in the range of 5–30 mms, means for supplying molten metal to the inlet end of said mould passage, means for applying liquid coolant to the broad faces of a metal strip emerging from the exit end of said mould passage and means for continuously withdrawing said emerging strip, said withdrawal means comprising at each side of the path of said emerging strip, a continuously moving belt-like member carrying strip-gripping means composed of resilient rubber-like material, the pair of belt-like members being spaced at such distance that they press the strip-gripping means into engagement with the narrow side faces of said strip; said means for gripping the strip at each side comprising an inner metallic band and bonded to said metallic band, an outer rubber-like belt having a channel-shaped recess therein, the width of the recess in said rubber-like belt being no greater than the thickness of the metal strip at its side edges, the inner surface of said metal band sliding over a stationary backing member positioned to hold said rubber-like belt firmly in contact with the narrow side faces of the metal strip.

5. A method for continuously casting metal in the form of a strip of a thickness in the range of 5 to 30 mm which comprises supplying molten metal to a fixed open ended casting mould having an essentially rectangular passage of a minimum transverse dimension in the range of 5 to 30 mm, cooling said molten metal into the form of a cast strip, gripping the cast strip only at its side edge regions, with resilient gripping means, after emergence of the strip from said mould and applying tension only to said gripped edges of said strip outwardly of the mould and only in the directions parallel to the axis of the mould passage to effect continuous withdrawal of cast strip from said mould.

6. A method according to claim 5 in which liquid coolant is applied to at least the broad faces of the metal strip issuing from said mould passage at a location adjacent to the mould exit.

7. A method according to claim 6 in which each side edge of the strip is gripped by pressing a resiliently deformable member laterally against said strip in a direction perpendicular to the direction of strip travel and to the side edge of the strip.

8. A method for continuously casting metal in the form of a strip of a thickness in the range of 5 to 30 mm which comprises supplying molten metal to a fixed open ended casting mould having an essentially rectangular passage of a minimum transverse dimension in the range of 5 to 30 mm, cooling said molten metal into the form of a cast strip, gripping the cast strip only at its side edge regions after emergence of the strip from said mould and applying tension to said gripped edges of said strip outwardly of the mould and in directions parallel to the axis of the mould passage to effect continuous withdrawal of cast strip from said mould, said method being further characterized: in the the molten metal is cooled by applying liquid coolant to at least the broad faces of the metal strip issuing from said mould passage at a location adjacent to the mould exit; and in that the strip is gripped adjacent each side edge by pressing a rubber-like member laterally against said side edge, said rubber-like member having a longitudinal groove therein of a normal transverse dimension no greater than the thickness of said strip.

9. A method according to claim 2 in which the locations at which said resilient gripping means are brought into gripping engagement with the opposed side edges of the cast strip are spaced away from the exit of said mould passage in the direction for strip withdrawal.

10. A method according to claim 1 in which the locations at which said resilient gripping means are brought into gripping engagement with the opposed side edges of the cast strip are spaced away from the exit of said mould passage in the direction for strip withdrawal.

* * * * *